US012139863B2

(12) United States Patent
Klein

(10) Patent No.: US 12,139,863 B2
(45) Date of Patent: Nov. 12, 2024

(54) GATE

(71) Applicant: Amos Klein, Haifa (IL)

(72) Inventor: Amos Klein, Haifa (IL)

( * ) Notice: Subject to any disclaimer, the term of this patent is extended or adjusted under 35 U.S.C. 154(b) by 706 days.

(21) Appl. No.: 17/420,273

(22) PCT Filed: Jan. 2, 2020

(86) PCT No.: PCT/IB2020/050010

§ 371 (c)(1),
(2) Date: Jul. 1, 2021

(87) PCT Pub. No.: WO2020/141471

PCT Pub. Date: Jul. 9, 2020

(65) Prior Publication Data

US 2022/0090336 A1 Mar. 24, 2022

Related U.S. Application Data

(60) Provisional application No. 62/787,791, filed on Jan. 3, 2019.

(51) Int. Cl.
*E01F 13/06* (2006.01)

(52) U.S. Cl.
CPC ..... *E01F 13/06* (2013.01)

(58) Field of Classification Search
CPC ..... E01F 13/06
USPC ..... 404/6, 9, 10
See application file for complete search history.

(56) References Cited

U.S. PATENT DOCUMENTS 1,651,221 A * 11/1927 O'Maley ..... E01F 13/02 116/63 P
2,137,193 A * 11/1938 Stafford ..... B61L 29/04 49/192
4,641,459 A * 2/1987 Mesa ..... E01F 13/085 49/35
4,759,655 A * 7/1988 Gorlov ..... E01F 13/12 49/34
4,923,327 A * 5/1990 Gorlov ..... E01F 13/046 404/9
6,155,744 A * 12/2000 Namanny ..... E01F 9/696 404/1
6,733,204 B1 * 5/2004 Paniccia ..... E01F 7/00 404/9
7,237,979 B2 * 7/2007 Behan ..... E01F 13/06 404/6

(Continued)

FOREIGN PATENT DOCUMENTS

FR 2854413 A1 11/2004
GB 2430964 A 4/2007

*Primary Examiner* — Raymond W Addie
(74) *Attorney, Agent, or Firm* — William H. Dippert; Laurence A. Greenberg; Werner H. Stemer

(57) ABSTRACT

The present subject matter provides a gate for controlling passage of vehicles including: at least one first blocking element configured to swivel about a first pivot axis; and at least one second blocking element configured to swivel about a second pivot axis, wherein the first blocking element and the second blocking element are configured to swivel one opposite the other in a manner that a gap is formed between the first blocking element and the second blocking element, wherein the gap is set to allow or block passage of vehicles through the gap. Additional embodiments of the gate are disclosed herein.

18 Claims, 5 Drawing Sheets

(56) References Cited

U.S. PATENT DOCUMENTS

| | | | | |
|---|---|---|---|---|
| 7,600,554 | B1 * | 10/2009 | Wright | E01F 7/00 160/327 |
| 7,614,819 | B1 * | 11/2009 | Mirman | E01F 13/065 40/607.05 |
| 8,001,880 | B2 * | 8/2011 | White | F41H 5/24 404/6 |
| 8,905,671 | B2 * | 12/2014 | Weatherwax | E01F 13/00 404/6 |
| 9,834,927 | B2 | 12/2017 | Huff | |
| 2007/0020044 | A1 * | 1/2007 | Stratton | E01F 13/028 404/9 |
| 2007/0126598 | A1 * | 6/2007 | Carter | E01F 13/06 340/908 |
| 2007/0237577 | A1 * | 10/2007 | Gelfand | E01F 13/123 404/6 |
| 2009/0116903 | A1 * | 5/2009 | Causey | E01F 13/06 404/6 |
| 2012/0207541 | A1 * | 8/2012 | Maus | E01F 15/086 404/6 |
| 2015/0117948 | A1 * | 4/2015 | Carlson | E01F 7/00 404/6 |
| 2015/0139726 | A1 * | 5/2015 | Burgin | E01F 13/06 404/6 |

* cited by examiner

GATE

CROSS-REFERENCE TO RELATED PATENT APPLICATIONS

This patent application is a U.S. National Phase filing under 35 U.S.C. § 371 of PCT Patent Application No. PCT/IB2020/050010, filed Jan. 2, 2020, which is based upon and claims the priority of U.S. Provisional Patent Application Ser. No. 62/787,791, filed Jan. 3, 2019, each of which is incorporated herein by reference in its entirety.

FIELD

The present subject matter relates to gates acting as a barrier. More particularly, the present subject matter relates to gates configured to be releasably placed.

BACKGROUND

Different barriers to block pedestrians as well as vehicles of different types and sizes are known in the art and the inventor of the subject matter described herein also describes in other documents effective barriers configured to block vehicles, especially vehicles aimed at getting into crowded places in very high speed. Such barriers that are erected from the ground can be fixed in place or portable and can be remotely controlled.

SUMMARY

Unless otherwise defined, all technical and scientific terms used herein have the same meaning as commonly understood by one of ordinary skill in the art to which this subject matter belongs. Although methods and materials similar or equivalent to those described herein can be used in the practice or testing of the present subject matter, suitable methods and materials are described below. In case of conflict, the patent specification, including definitions, will control. In addition, the materials, methods, and examples are illustrative only and not intended to be limiting.

There is a need to releasably place a gate that act as a barrier and is able to either block or allow passage of either pedestrians, or vehicles or pedestrians and vehicles.

According to one aspect of the present subject matter, there is provided a gate for controlling passage of vehicles comprising: at least one first blocking element configured to swivel about a first pivot axis; and at least one second blocking element configured to swivel about a second pivot axis, wherein the first blocking element and the second blocking element are configured to swivel one opposite the other in a manner that a gap is formed between the first blocking element and the second blocking element, wherein the gap is set to allow or block passage of vehicles through the gap.

According to one embodiment, the first blocking element and the second blocking element are configured to be releasably placed on a surface.

According to another embodiment, the first blocking element and the second blocking element are configured to be permanently placed on the surface.

According to yet another embodiment, the surface is a ground.

According to still another embodiment, the surface is a base configured to be placed on a ground.

According to a further embodiment, the base is configured to be removably placed on the ground.

According to yet a further embodiment, the base is configured to be permanently placed on the ground.

According to still a further embodiment, the first blocking element comprises a first pole configured to serve as the first pivot axis of the first blocking element, and a second pole connected to the first pole with an upper connector, and wherein the second blocking element comprises a third pole configured to serve as the second pivot axis of the second blocking element, and a fourth pole connected to the first pole with an upper connector.

According to an additional embodiment, the gap is between the second pole and the fourth pole.

According to yet an additional embodiment, at least one of the first pole of the first blocking element and the third pole of the second blocking element is configured to be releasably caught in the surface.

According to still an additional embodiment, at least one of the first pole of the first blocking element and the third pole of the second blocking element is configured to be permanently caught in the surface.

According to another embodiment, at least one of the upper connectors is linear.

According to yet another embodiment, at least one of the upper connectors is arched.

According to still another embodiment, at least one of the blocking elements is made of a separate first pole or third pole, a separate second pole or fourth pole, respectively, and a separate upper connector, that are connected one to the other.

According to a further embodiment, at least one of the blocking elements is made of one piece of material in a shape comprising the first pole or third pole, respectively, the second pole or the fourth pole, and the upper connector.

According to yet a further embodiment, in at least one of the blocking elements, the first pole or third pole, and the upper connector are made of one piece of material connected to the second pole or fourth pole, respectively.

According to still a further embodiment, in at least one of the blocking elements, the second pole or fourth pole and the upper connector are made of one piece of material connected to the first pole or third pole, respectively.

According to an additional embodiment, the gate is configured to be either in a vehicle blocking state or in a vehicle passage state.

According to yet an additional embodiment, the gate is in a vehicle blocking state when the gap between the first blocking element and the second blocking element is set to be narrow enough to prevent passage of the vehicles, and wherein movement of vehicles through the gate is allowed when the gap is set to be broad enough.

According to still an additional embodiment, the gate further comprising at least one locking recess for locking a bottom end of at least one blocking element that swivels about the pivot axis.

According to another embodiment, the blocking element is configured to be releasably locked by the at least one locking recess.

According to yet another embodiment, the gate further comprising at least one shutter configured to block passage of pedestrians through the gate when in closed state.

According to still another embodiment, one of the at least one shutter is configured to block passage of pedestrians through the first blocking element or the second element.

According to a further embodiment, one of the at least one shutter is configured to block passage of pedestrians through the gap.

According to yet a further embodiment, the shutter is a roll-up shutter.

According to still a further embodiment, the shutter is pivotally attached to at least one of the blocking elements.

According an additional embodiment, the shutter is a foldable mesh shutter.

According to yet an additional embodiment, the foldable mesh shutter is attached to at least one of the blocking elements.

According to still an additional embodiment, the foldable mesh shutter comprises a first shutter part and a second shutter part, each shutter part is attached to a different pole of a blocking element.

BRIEF DESCRIPTION OF THE DRAWINGS

Embodiments are herein described, by way of example only, with reference to the accompanying drawings. With specific reference now to the drawings in detail, it is stressed that the particulars shown are by way of example and for purposes of illustrative discussion of the preferred embodiments, and are presented in the cause of providing what is believed to be the most useful and readily understood description of the principles and conceptual aspects of the embodiments. In this regard, no attempt is made to show structural details in more detail than is necessary for a fundamental understanding, the description taken with the drawings making apparent to those skilled in the art how several forms can be embodied in practice.

In the drawings.

DESCRIPTION OF THE PREFERRED EMBODIMENTS

Figure 1:
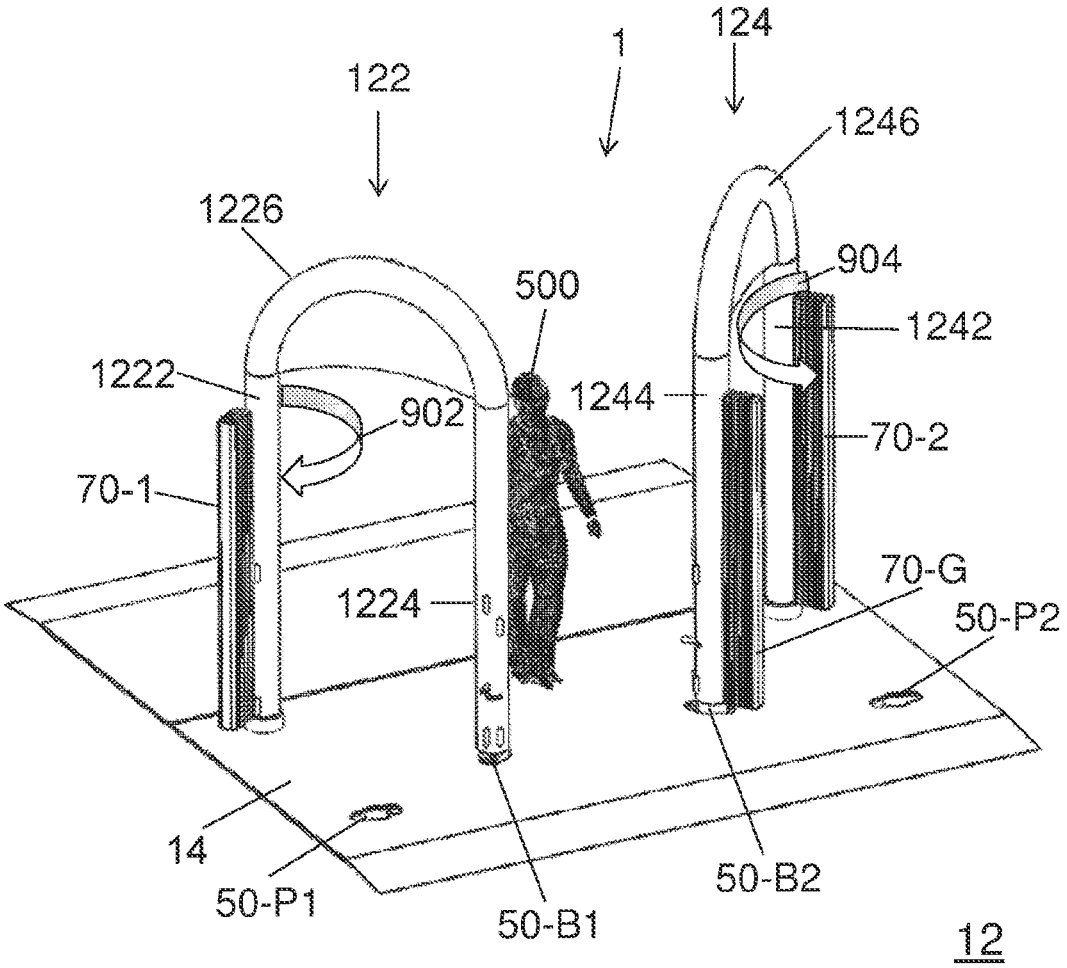
FIG. 1 schematically illustrates, according to an exemplary embodiment, a front perspective view of a gate in a vehicle blocking state.

Before explaining at least one embodiment in detail, it is to be understood that the subject matter is not limited in its application to the details of construction and the arrangement of the components set forth in the following description or illustrated in the drawings. The subject matter is capable of other embodiments or of being practiced or carried out in various ways. Also, it is to be understood that the phraseology and terminology employed herein is for the purpose of description and should not be regarded as limiting. In discussion of the various figures described herein below, like numbers refer to like parts. The drawings are generally not to scale.

For clarity, non-essential elements were omitted from some of the drawings.

The term "vehicle" as disclosed herein relates to a terrestrial vehicle, as known in the art, in which people travel, or by which things are carried or conveyed.

The terms "pedestrian" as disclosed herein relates to walking human being, as well as objects similar in size, for example bicycles, motorcycles, animals, and the like.

The term "ground" as disclosed herein relates to any surface known in the art on which pedestrians and vehicles can move, for example a road, a pavement, a path, a trail, a walkway, a highway, soil, ground and the like.

The present subject matter provides a gate configured to control passage of vehicles, pedestrians, or both. The gate comprising at least one first blocking element configured to swivel about a first pivot axis, and at least one second blocking element configured to swivel about a second pivot axis wherein the first blocking element and the second blocking element are configured to swivel one opposite the other in a manner that a gap is formed between the first blocking element and the second blocking element, wherein the gap is set to allow or block passage of vehicles through the gap.

Optionally, the blocking elements can be swivebly connected to a surface that is placed on the ground.

According to one embodiment, the first blocking element and the second blocking element are configured to be releasably placed on the surface. According to another embodiment, the first blocking element and the second blocking element are configured to be permanently placed on the surface.

Each blocking element swivels about its fixture to the surface so that the blocking elements pivot one opposite to the other as will be explained herein after. According to the pivoting state of the blocking elements that controls the gap between the elements, in one embodiment, the gate is configured to be in a vehicle blocking state, in which the gate blocks passage of vehicles. According to another embodiment, the gate is configured to be in a vehicle passage state, in which the gap is maximal and the gate allows passage of vehicles. Pedestrians are allowed to pass through the gate in all gaps, however, according to yet another embodiment, the gate is configured to be in a vehicle and pedestrian blocking state, in which the gate blocks passage of both vehicles and pedestrians.

Figure 2:
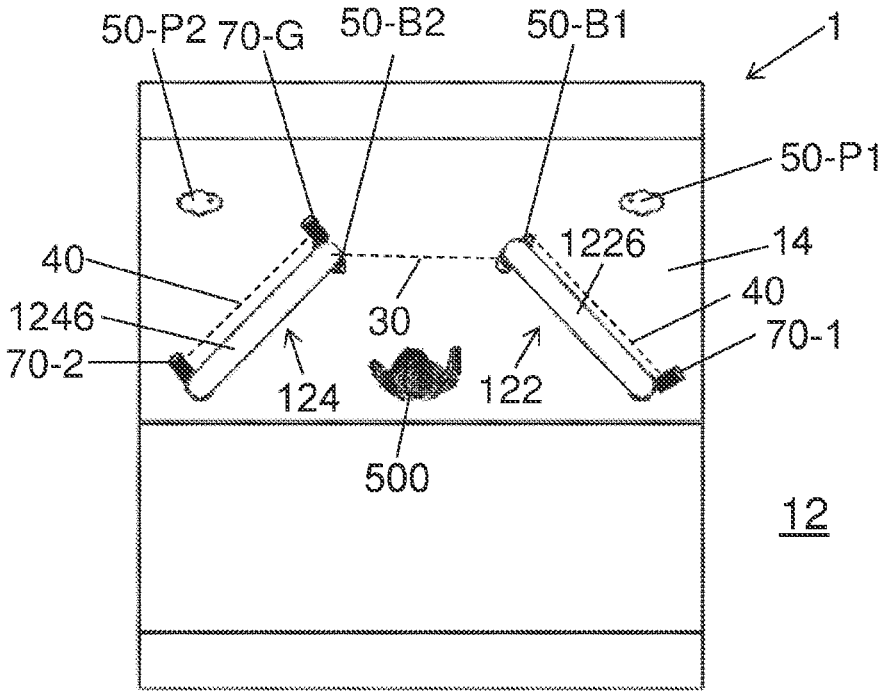
FIG. 2 schematically illustrates, according to an exemplary embodiment, a top view of a gate in a vehicle blocking state as shown in FIG. 1.
Figure 3:
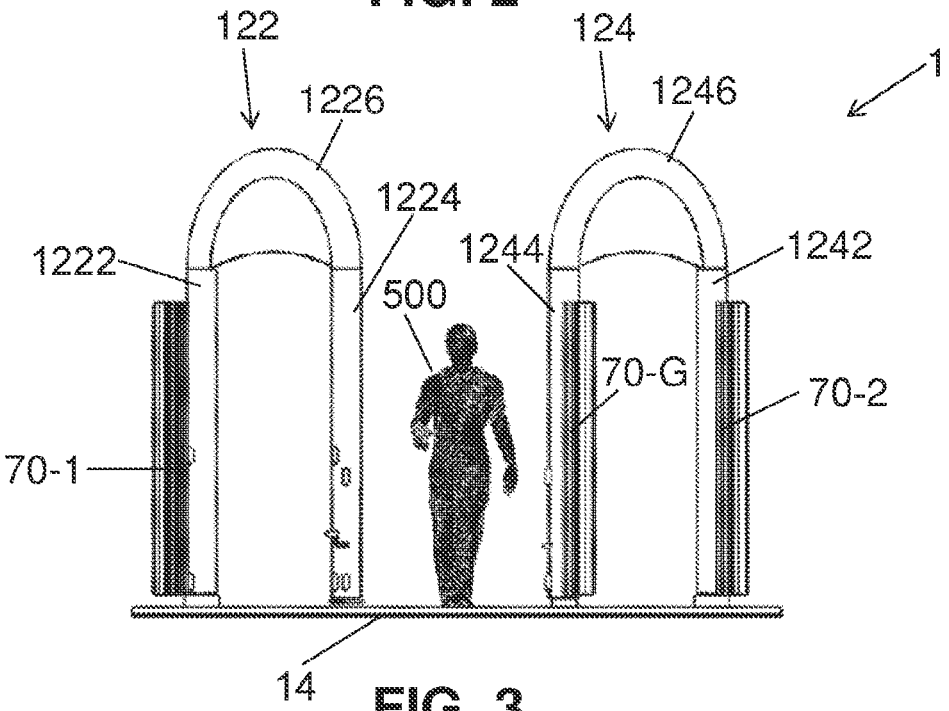
FIG. 3 schematically illustrates, according to an exemplary embodiment, a front view of a gate in a vehicle blocking state.

Reference is now being made to FIGS. 1 to 3 schematically illustrates, according to an exemplary embodiment, a front perspective view, a top view and a front view, respectively, of a gate in a vehicle blocking state.

FIG. 1 illustrates the gate 1 comprising a first blocking element 122 and a second blocking element 124. Both first blocking element 122 and second blocking element 124 are configured to be placed on a surface 14. According to one embodiment, the first blocking element 122 is swivebly connected to the surface 14. According to another embodiment, the second blocking element 124 is swivebly connected to the surface 14. According to yet another embodiment, both the first blocking element 122 and the second blocking element 124 are swivebly connected to the surface 14. Any one of the two blocking elements is configured to swivel about a pivot axis.

It should be noted that the gate as shown in the figures is placed on surface 14 wherein the surface 14 can be a base for the gate that is configured to be placed on the ground 12; however, in accordance with another embodiment, the gate is placed directly on the ground as defined above.

According to one embodiment, the surface 14 is configured to be placed on the ground 12. According to yet another embodiment, the surface 14 is configured to be removably placed on the ground. According to still another embodiment, the surface 14 is configured to be permanently placed on the ground, for example by permanently connecting the surface to the ground.

According to one embodiment, at least one of the first blocking element 122 and the second blocking element 124 are configured to be placed on the surface 14. According to another embodiment, at least one of the first blocking element 122 and the second blocking element 124 is configured to connect to the surface 14 in a way that the elements are swiveling about a pivoting axis.

As can be seen in the figures of the present application, the surface 14 is a base mounted on the ground 12. Nevertheless, the illustration of the base serving as a surface 14 should not be considered as limiting the scope of the present subject matter. The surface 14 can be a ground as well.

According to one embodiment, the first blocking element 122 comprises a first pole 1222 configured to be caught in the surface 14 and serve as a pivot axis of the first blocking element 122, and a second pole 1224 connected to the first pole 1222 with an upper connector 1226. Similarly, the second blocking element 124 comprises a third pole 1242 configured to be caught in the surface 14 and serve as a pivot axis of the second blocking element 124, and a fourth pole 1244 connected to the third pole 1242 with an upper connector 1246.

According to one embodiment, at least one of the first pole 1222 of the first blocking element 122 and the third pole 1242 of the second blocking element 124 is configured to be releasably caught in the surface 14. According to another embodiment, at least one of the first pole 1222 of the first blocking element 122 and the third pole 1242 of the second blocking element 124 is configured to be permanently caught in the surface 14.

According to some embodiments, the upper connector 1226/1246 can have any shape, for example at least one of the upper connectors 1226/1246 is linear (not shown), or arched as shown for example in FIG. 1, and the like.

The upper connectors can be utilized also to different uses such as illumination. In a preferred embodiment, the upper connector is provided with an illuminating LEDS or other type of illuminator so as to provide light to the area of the gate. The upper connector can also be used for placing signposts indicating exit, directions, arrows, explanations, or the like.

According to one embodiment, at least one of the blocking elements 122/124 is made of separate parts connected one to the other, namely a separate first/third pole 1222/1242, a separate second/fourth pole 1224/1244, and a separate upper connector 1226/1246 that are connected one to the other. According to another embodiment, at least one of the blocking elements 122/124 is made of one piece of material in a shape comprising the first/third pole 1222/1242, the second/fourth pole 1224/1244, and the upper connector 1226/1246. According to yet another embodiment, in at least one of the blocking elements 122/124, the first/third pole 1222/1242 and the upper connector 1226/1246 are made of one piece of material connected to the second/fourth pole 1224/1244. According to still another embodiment, in at least one of the blocking elements 122/124, the second/fourth pole 1224/1244 and the upper connector 1226/1246 are made of one piece of material connected to the first/third pole 1222/1242.

According to one embodiment, the first blocking element 122 is configured to allow passage of a pedestrian therethrough, and the second blocking element 124 is configured to allow passage of a pedestrian therethrough. This embodiment is achieved because a distance between the first/third pole 1222/1242 and the second/fourth pole 1224/1244, designated in FIG. 2 with dashed line 40, allows passage of a pedestrian therethrough (between the poles of a single blocking element). According to another embodiment, the first blocking element 122 is configured to block passage of a vehicle therethrough, and the second blocking element 124 is configured to block passage of a vehicle therethrough. This embodiment is achieved because the distance 40 between the first/third pole 1222/1242 and the second/fourth pole 1224/1244 blocks passage of a vehicle therethrough.

According to one embodiment, the first blocking element 122 is configured to swivel about the first pole 1222, since the first pole 1222 serves as a first pivot axis of the first blocking element 122. The swivel movement that the first blocking element 122 is configured to perform is designated in FIG. 1 with arrow 902. Similarly, the second blocking element 124 is configured to swivel about the third pole 1242, since the third pole 1242 serves as a second pivot axis of the second blocking element 124. The swivel movement that the second blocking element 124 is configured to perform is designated in FIG. 1 with arrow 904.

According to one embodiment, the gate 1 is configured to be either in a vehicle blocking state or in a vehicle passage state. This embodiment is achieved by changing the orientation of the first blocking element 122 or the second blocking element 124, or both the first blocking element 122 and the second blocking element 124, one relative to the other while forming a gap therebetween. The gate 1 illustrated in FIG. 1 and in the following FIGS. 2 and 3, is in a vehicle blocking state when the gap between the first blocking element and the second blocking element is set to be narrow enough to prevent passage of the vehicles.

According to one embodiment, the gate 1 illustrated in FIGS. 1-3 is in a vehicle blocking state. In this embodiment, the orientation of the first blocking element 122 and the second blocking element 124 is such that a gap 30, illustrated with dashed line 30 in FIG. 2, between the first blocking element 122 and the second blocking element 124 does not allow passage of a vehicle. Therefore, in the vehicle blocking state, the gate 1 blocks passage of a vehicle through the gate 1. However, as can be seen in FIGS. 1-3, the gap 30 between the poles of the first blocking element 122 and the second blocking element 124 allow passage of pedestrians 500. As can be clearly seen in the frontal view of FIG. 3, vehicles cannot pass through the gate since the poles are too close to each other, leaving only small gaps between them. These gaps allow people to pass through but not vehicles.

According to one embodiment illustrated for the orientation example in FIG. 1, at least one locking recess 50, for locking a blocking element 122/124 in a certain position, is made in the surface 14. Thus, an at least one locking recess 50 is made in the surface on which the gate 1 is placed. According to another embodiment, a second pole 1224/1244 of a blocking element 122/124 is configured to be locked in a locking recess 50, for example by inserting a lower end of the second pole 1224/1244 into the locking recess 50.

Figure 4:
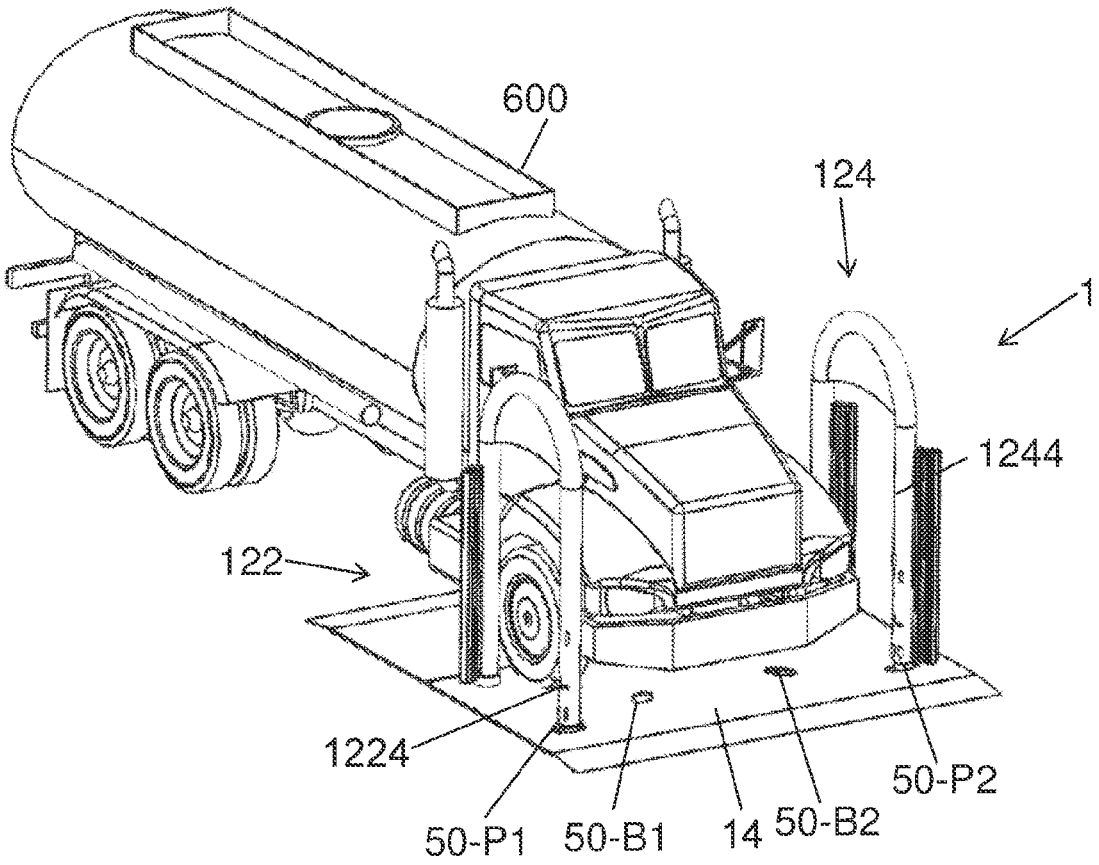
FIG. 4 schematically illustrates, according to an exemplary embodiment, a front perspective view of a gate in a vehicle passage state.

According to one embodiment, the gate 1 can comprise either at least one locking recess 50-B1 for locking the end of pole 1224, or at least one locking recess 50-B2 for locking the end of pole 1244; or both. As illustrated in FIGS. 1-3, when the end of second pole 1224 of the first blocking element 122 is locked within locking recess 50-B1 and the end of the second pole 1244 of the second blocking element 124 is locked within locking recess 50-B2, the gate 1 is in a vehicle blocking state. In other words, the gap 30 between locking recess 50-B1 for locking the first blocking element 124, and locking recess 50-B2 for locking the second blocking element 124, does not allow passage of a vehicle 600 (the vehicle is shown in FIG. 4). Thus, locking recess 50-B1 and locking recess 50-B2 can be considered as locking recesses 50 for a vehicle blocking state of the gate 1.

It should be noted that optionally, the recess can be also a full hole in the case that the surface is a base on the ground.

Figure 5:
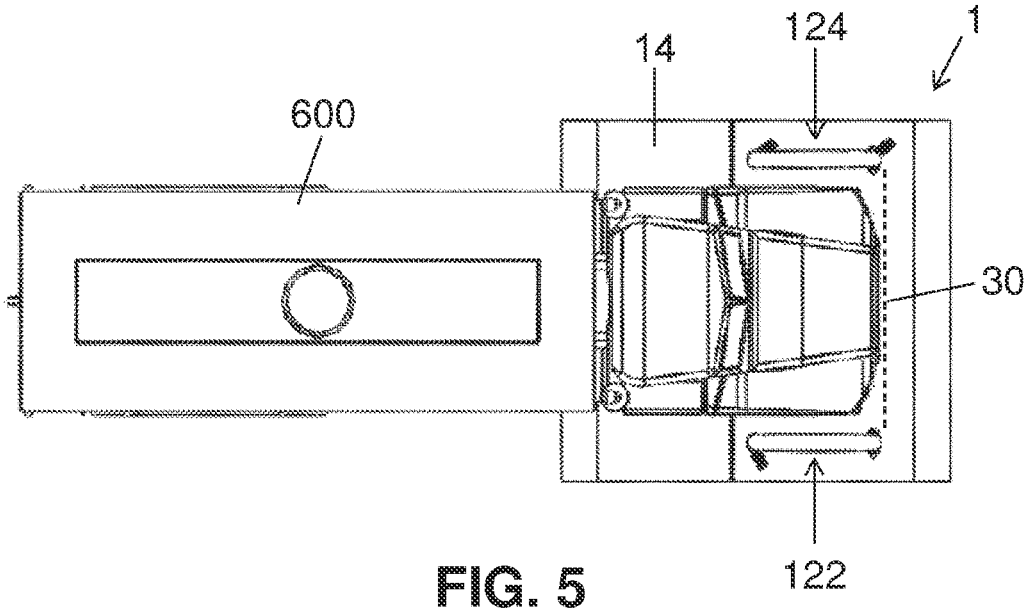
FIG. 5 schematically illustrates, according to an exemplary embodiment, a top view of a gate in a vehicle passage state.
Figure 6:
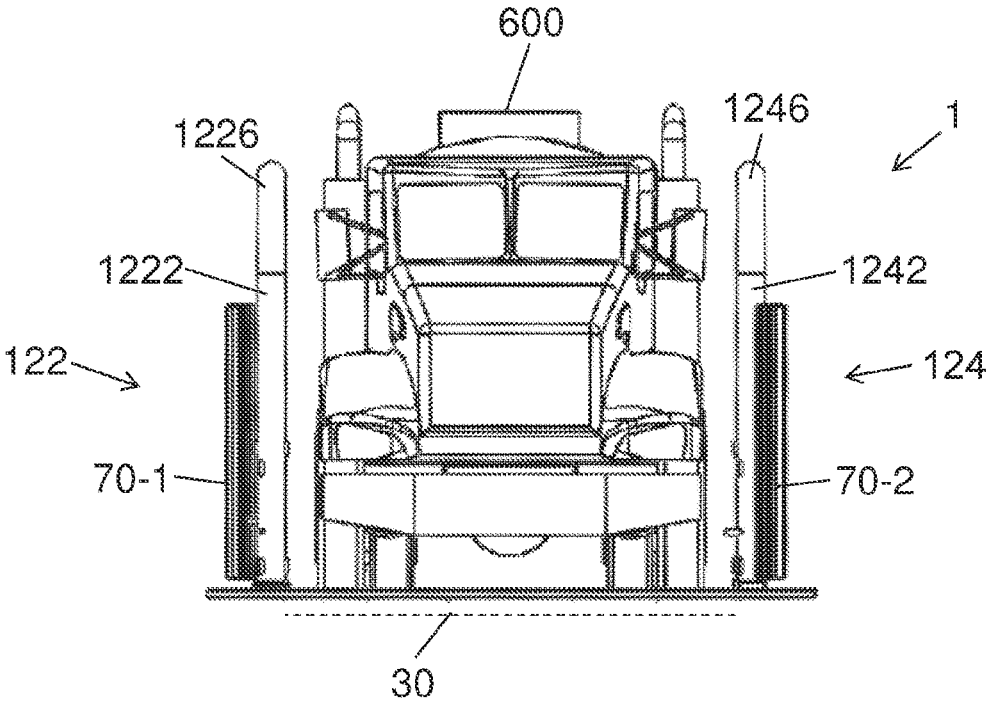
FIG. 6 schematically illustrates, according to an exemplary embodiment, a front view of a gate in a vehicle passage state.

Reference is now made to FIGS. 4-6 schematically illustrating, according to an exemplary embodiment, a front perspective view, a top view, and a frontal view, respectively, of a gate in a vehicle passage state and a vehicle passing through the gate.

According to one embodiment, the gate 1 illustrated in FIGS. 4-6 is in a vehicle passage state. In this embodiment, the orientation of the first blocking element 122 and the second blocking element 124 is such that the gap 30 (indicated in FIG. 5) between the first blocking element 122 and the second blocking element 124 allow passage of a vehicle 600. The blocking elements 122 and 124 are oriented in a position in which they are substantially parallel to one another and the gap between them is maximal while no poles are situated within the gap 30. Movement of vehicles through the gate is allowed when the gap is set to be broad enough. Therefore, in the vehicle passage state, the gate 1 allows passage of a vehicle through the gate 1. Needless to mention that in the vehicle passage state, the gate 1 also allows passage of pedestrians through the gap 30 between the first blocking element 122 and the second blocking element 124.

According to another embodiment, the gate 1 comprises either a locking recess 50-P1 for locking the lower end of pole 1224 of the first blocking element 122, or/and a locking recess 50-P2 for locking the lower end of pole 1244 of the second blocking element 124. As illustrated in FIGS. 4-6, when the lower end of the second pole 1224 of the first blocking element 122 is locked by locking recess 50-P1 and the lower end of the second pole 1244 of the second blocking element 124 is locked by locking recess 50-P2, the gate 1 is in a vehicle passage state. In other words, the gap 30 between locking recess 50-P1 for locking the first blocking element 122 and locking recess 50-P2 for locking the second blocking element 124 allow passage of a vehicle 600. Thus, locking recess 50-P1 and locking recess 50-P2 can be considered as locking recess 50 for a vehicle passage state of the gate 1.

It should be noted that according to some embodiments, the gate 1 can comprise any number of locking holes 50 either for the first blocking element 122, or the second blocking element 124, or both the first blocking element 122 and the second blocking element 124. Furthermore, it should be noted that the orientation of the first blocking element 122 and the second blocking element 124, with or without locking holes 50 can be any orientation that can be deemed useful or necessary to the circumstances and conditions in which the gate 1 is used.

According to one embodiment, the blocking element 122/124 is configured to be permanently locked by the at least one locking recess 50. According to another embodiment, the blocking element 122/124 is configured to be releasably locked by the at least one locking recess 50.

According to one embodiment, the first blocking element 122 is configured to be permanently locked by locking recess 50-P1, while the second blocking element 124 is configured to be releasably locked by locking recess 50-P2. According to another embodiment, the first blocking element 122 is configured to be releasably locked by locking recess 50-P1, while the second blocking element 124 is configured to be permanently locked by locking recess 50-P2. According to yet another embodiment, both the first blocking element 122 is configured to be permanently locked by locking recess 50-P1 and the second blocking element 124 is configured to be permanently locked by locking recess 50-P2. It should be noted that in the aforementioned embodiments, the gate 1 can be either in a vehicle blocking state, or a vehicle passage state, depending on the gap 30 between the first blocking element 122 and the second blocking element 124.

According to one embodiment, the gate 1 further comprises at least one shutter 70 configured to block passage of pedestrians through the gate 1 (the indication of the different shutters shown in the figures is by an extension to the number 70, such as 70-1, 70-2, and 70-G). According to one embodiment, the shutter 70 is configured to block passage of pedestrians through a blocking element 122/124. According to another embodiment, the shutter 70 is configured to block passage of pedestrians through the gap 30 between the first blocking element 122 and the second blocking element 124. According to a further embodiment, illustrated for example in FIG. 1, the gate 1 comprises a first shutter 70-1 configured to block passage of pedestrians through the first blocking element 122. According to yet a further embodiment, the gate 1 comprises a second shutter 70-2 configured to block passage of pedestrians through the second blocking element 122. According to still a further embodiment, the gate 1 comprises a first shutter 70-1 configured to block passage of pedestrians through the first blocking element 122, and a second shutter 70-2 configured to block passage of pedestrians through the second blocking element 122. According to yet another embodiment, the gate 1 can comprise a gap shutter 70-G configured to block passage of pedestrians through the gap 30 between the first blocking element 122 and the second blocking element 124.

According to one embodiment, the shutter 70 is configured to be in an open state—allowing passage of pedestrians. According to another embodiment, the shutter 70 is configured to be in a closed state—blocking passage of pedestrians. Any mechanism known in the art that allows the shutter 70 to be in an open state or a closed state is under the scope of the present subject matter, for example, when the shutter 70 is in a form of a foldable mesh folding and opening aside, in a form of a rolling shutter folding and opening up and down, in a form of a door pivotally connected to one of the poles, and the like. In the closed state, the shutter 70 blocks passage of pedestrians. In the open state, the shutter 70 allows passage of pedestrians. It should be noted that in this sense, the first shutter 70-1, the second shutter 70-2 and the gap shutter 70-G are independent, namely each one of the shutters 70 can be in a closed state or in an open state independently of the other shutters 70 of the gate 1.

Any type of shutter 70 known in the art is under the scope of the present subject matter. It should be noted that the following examples of a shutter 70 should not be considered as limiting the scope of the present subject matter.

For example, the shutter 70 is a roll-up shutter 70. The roll-up shutter attached to an upper part of the first blocking element 122, or of the second blocking element 124, or both the first blocking element 122 and the second blocking element 124. For example, the roll-up shutter 70 is attached to the blocking element 122/124 in the vicinity of the upper connector 1226/1246.

Another exemplary shutter 70 is a shutter 70 pivotally attached to one of the poles of a blocking element 122/124. This type of shutter is configured to open and close by swiveling about the pole of the pole to which the shutter 70 is attached.

Yet another exemplary shutter 70 is a foldable mesh shutter 70 or in other words—garmoshka-like shutter 70. This type of shutter 70 is described herein and illustrated in the accompanying drawings, but as stated above, it is described only as an exemplary type of shutter 70.

According to one embodiment, the foldable mesh shutter 70 is attached to one of the poles of a blocking element. According to one embodiment, illustrated for example in FIG. 1, the first foldable mesh shutter 70-1 is attached to the first pole 1222 of the first blocking element 122. According to another embodiment, the first foldable mesh shutter 70-1 is attached to the second pole 1223 of the first blocking element 122 (not shown). According to yet another embodiment, illustrated for example in FIG. 1, the second foldable mesh shutter 70-2 is attached to the third pole 1242 of the second blocking element 124. According to still another embodiment, the second foldable mesh shutter 70-2 is attached to the second pole 1244 of the second blocking element (not seen). According to a further embodiment, illustrated for example in FIG. 1, the gap foldable mesh shutter 70-G is attached to the fourth pole 1244 of the second blocking element 124. According to yet a further embodiment, the gap shutter 70-G is attached to the second pole 1224 of the first blocking element 122.

It should be noted that the aforementioned embodiments of the shutters 70 and their mechanism of being in an open state or a closed state are only exemplary. For example, according to some other embodiments, the foldable mesh shutter 70 can comprise a first shutter part and a second shutter part, each shutter part is attached to a different pole of a blocking element 122/124. Thus, bringing the shutter 70 to a closed state can be performed, for example, by approximating the first shutter part and the second shutter part one to the other, and connecting the first shutter part and the second shutter part one to the other in a manner that prevents passage of pedestrians through the gap that is now blocked by the first shutter part and the second shutter part.

FIGS. 1-3 illustrate the first shutter 70-1, the second shutter 70-2 and the gap shutter 70-G in an open state, allowing passage of pedestrians.

Figure 7:
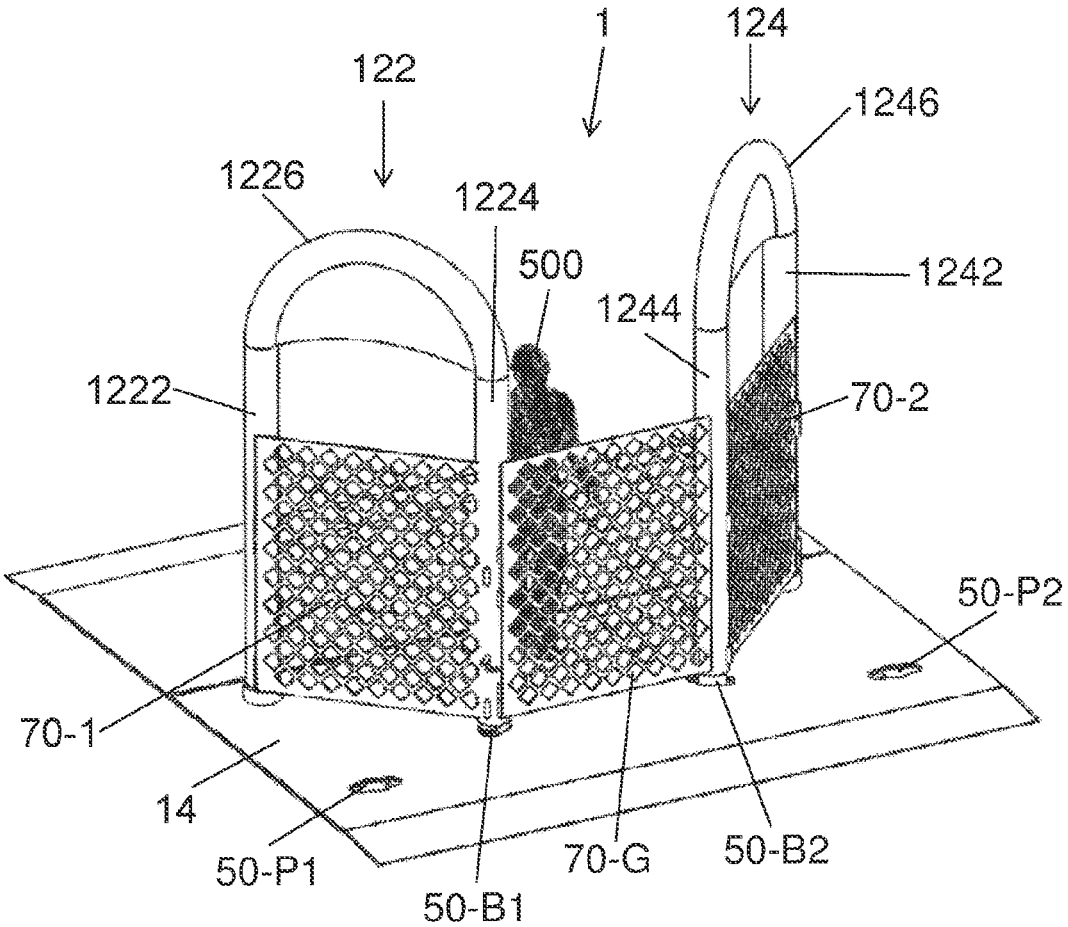
FIG. 7 schematically illustrates, according to an exemplary embodiment, a front perspective view of a gate in a vehicle blocking state, while shutters of the gate are in a closed state.

Reference is now made to FIG. 7 schematically illustrating, according to an exemplary embodiment, a front perspective view of a gate in a vehicle blocking state, while the shutters of the gate are in a closed state.

FIG. 7 illustrates a gate 1 comprising shutters 70 in a closed state, configured to prevent passage of pedestrians. According to the exemplary embodiment of a shutter 70 in the form of a foldable mesh, the shutter 70 is folded in the open state, as illustrated for example in FIGS. 1-3. On the other hand, in the closed state, as illustrated in FIG. 7, the shutter 70 is unfolded and blocks passage of pedestrians. In this exemplary embodiment, when the shutter 70 is in the closed state, an edge of the shutter 70 in the form of a foldable mesh is attached to an opposite pole in relation to the pole to which the shutter is attached.

To summarize, the gate 1 of the present subject matter can be in of three states: a vehicle blocking and pedestrians passage state, as illustrated in FIGS. 1-3; a vehicle and pedestrians passage state, as illustrated in FIGS. 4-6; and a vehicle and pedestrians blocking state, as illustrated in FIG. 7.

It is appreciated that certain features of the subject matter, which are, for clarity, described in the context of separate embodiments, can also be provided in combination in a single embodiment. Conversely, various features of the subject matter, which are, for brevity, described in the context of a single embodiment, can also be provided separately or in any suitable sub combination.

Although the subject matter has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A gate for controlling passage of vehicles comprising:

at least one first blocking element comprising a first vertical pole, a third vertical pole, and an upper horizontal connector, wherein the first blocking element is configured to swivel about a first pivot axis, which is the first pole;

at least one second blocking element comprising a second vertical pole, a fourth vertical pole, and an upper horizontal connector, wherein the second blocking element is configured to swivel about a second pivot axis, which is the second pole: and a base onto which the first blocking element and the second blocking element are placed wherein the base can be removably or permanently placed on a ground, wherein the first blocking element and the second blocking element are configured to swivel one opposite the other in a manner that a gap is formed between the first blocking element and the second blocking element, and wherein the gap is set to allow or block passage of vehicles through the gap.

2. The gate of claim 1, wherein the first blocking element and the second blocking element are configured to be releasably placed on the base or to be permanently placed on the base.

3. The gate of claim 1, wherein the gap is between the second pole and the fourth pole.

4. The gate of claim 1, wherein at least one of the first pole of the first blocking element and the third pole of the second blocking element is configured to be releasably caught in the base.

5. The gate of claim 1, wherein at least one of the first pole of the first blocking element and the third pole of the second blocking element is configured to be permanently caught in the base.

6. The gate of claim 1, wherein at least one of the upper connectors is linear or arched.

7. The gate of claim 1, wherein at least one of the blocking elements is made of a separate first pole or third pole, a separate second pole or fourth pole, respectively, and a separate upper connector, that are connected one to the other.

8. The gate of claim 1, wherein at least one of the blocking elements is made of one piece of material in a shape comprising the first pole or third pole, respectively, the second pole or the fourth pole, and the upper connector.

9. The gate of claim 1, wherein in at least one of the blocking elements, the first pole or third pole, and the upper connector are made of one piece of material connected to the second pole or fourth pole, respectively.

10. The gate of claim 1, wherein in at least one of the blocking elements, the second pole or fourth pole and the upper connector are made of one piece of material connected to the first pole or third pole, respectively.

11. The gate of claim 1, wherein the gate is configured to be either in a vehicle blocking state or in a vehicle passage state.

12. The gate of claim 11, wherein the gate is in a vehicle blocking state when the gap between the first blocking element and the second blocking element is set to be narrow enough to prevent passage of the vehicles, and wherein movement of vehicles through the gate is allowed when the gap is set to be broad enough.

13. The gate of claim 1, further comprising at least one locking recess for locking a bottom end of at least one blocking element that swivels about the pivot axis.

14. The gate of claim 13, wherein the blocking element is configured to be releasably locked by the at least one locking recess.

15. The gate of claim 1, further comprising at least one shutter configured to block passage of pedestrians through the gate when in closed state and wherein the shutter is attached to at least one of the vertical poles.

16. The gate of claim 15, wherein one of the at least one shutter is configured to block passage of pedestrians through at least one of the first blocking element, the second blocking element, and the gap.

17. The gate of claim 15, wherein the shutter is a roll-up shutter or a foldable mesh shutter.

18. The gate of claim 15, wherein the shutter is pivotally attached to at least one of the blocking elements.

* * * * *